US006726067B2

(12) United States Patent
Louw

(10) Patent No.: US 6,726,067 B2
(45) Date of Patent: Apr. 27, 2004

(54) GARMENT HANGER AND INFORMATION INDICATOR THEREFOR

(75) Inventor: Henry John Louw, Bergvliet (ZA)

(73) Assignee: Visconti Polyoak Ltd. (ZA)

( * ) Notice: Subject to any disclaimer, the term of this patent is extended or adjusted under 35 U.S.C. 154(b) by 0 days.

(21) Appl. No.: 10/155,642

(22) Filed: May 22, 2002

(65) Prior Publication Data

US 2003/0173381 A1 Sep. 18, 2003

Related U.S. Application Data

(60) Provisional application No. 60/363,890, filed on Mar. 13, 2002.

(51) Int. Cl.[7] ..... A41D 27/22
(52) U.S. Cl. ..... 223/85; 40/322
(58) Field of Search ..... 223/85; 40/322

(56) References Cited

U.S. PATENT DOCUMENTS

| | | | | |
|---|---|---|---|---|
| 3,024,953 | A | | 3/1962 | O'Keefe |
| 4,115,940 | A | | 9/1978 | Phillips |
| 4,137,661 | A | | 2/1979 | Johansson |
| 4,322,902 | A | | 4/1982 | Lenthall |
| D301,661 | S | | 6/1989 | Wilson |
| D301,943 | S | | 7/1989 | Wilson |
| D302,214 | S | | 7/1989 | Wilson |
| D303,325 | S | | 9/1989 | Marshall |
| 4,863,078 | A | | 9/1989 | Bengsch |
| 4,886,195 | A | | 12/1989 | Blanchard |
| 4,967,500 | A | | 11/1990 | Bredeweg |
| 4,997,114 | A | | 3/1991 | Petron |
| 5,065,852 | A | | 11/1991 | Marti |
| 5,096,101 | A | | 3/1992 | Norman et al. |
| 5,135,141 | A | | 8/1992 | Harmer et al. |
| D329,754 | S | | 9/1992 | Gouldson et al. |
| D332,180 | S | | 1/1993 | Marshall et al. |
| D341,947 | S | | 12/1993 | Marshall et al. |
| 5,272,806 | A | | 12/1993 | Marshall et al. |
| 5,285,566 | A | | 2/1994 | Marshall et al. |
| 5,305,933 | A | | 4/1994 | Zuckerman |
| 5,377,884 | A | | 1/1995 | Zuckerman |
| 5,388,354 | A | | 2/1995 | Marshall et al. |
| 5,503,310 | A | * | 4/1996 | Zuckerman et al. ..... 223/85 |
| 5,507,086 | A | | 4/1996 | Marshall et al. |
| 5,509,587 | A | | 4/1996 | Gouldson et al. |
| 5,516,013 | A | | 5/1996 | Gouldson et al. |
| D371,246 | S | | 7/1996 | Gouldson et al. |
| D376,263 | S | | 12/1996 | Gouldson |
| D377,717 | S | | 2/1997 | Gouldson |
| 5,603,437 | A | | 2/1997 | Zuckerman |

(List continued on next page.)

FOREIGN PATENT DOCUMENTS

| | | |
|---|---|---|
| AU | A 1-57011/80 | 3/1980 |
| AU | B1-55 988/80 | 2/1982 |
| AU | A-32008/84 | 8/1984 |
| WO | WO 90/09651 | 8/1990 |

OTHER PUBLICATIONS

Patents Act 1977: Search Report under Section 17, dated Jun. 23, 2003.

*Primary Examiner*—John J. Calvert
*Assistant Examiner*—James G Smith
(74) *Attorney, Agent, or Firm*—Ostrolenk, Faber, Gerb & Soffen, LLP

(57) ABSTRACT

A garment hanger an and associated indicator therefor. The garment hanger has a projecting web which includes at least one recess on one side thereof. The indicator includes a body having a pair of side walls, a pair of end walls connecting the side walls, a top wall and an open end arranged so as to define a cavity which is dimensioned to receive the projecting web of the hanger. The indicator further includes an abutment positioned on one side wall of the pair of side walls. The abutment is dimensioned so as to engage the at least one recess of the projecting web of the hanger and is located proximal to the top wall relative to a midpoint of the cavity between the open end and the top wall.

15 Claims, 2 Drawing Sheets

U.S. PATENT DOCUMENTS

| | | | |
|---|---|---|---|
| 5,604,975 | A | 2/1997 | Marshall et al. |
| 5,628,132 | A | 5/1997 | Marshall et al. |
| 5,632,423 | A | 5/1997 | Louw |
| 5,641,100 | A | 6/1997 | Mitchell et al. |
| D381,814 | S | 8/1997 | Louw |
| 5,687,887 | A | 11/1997 | Bond et al. |
| D396,353 | S | 7/1998 | Gouldson |
| 5,775,553 | A | 7/1998 | Marshall et al. |
| 5,778,575 | A | 7/1998 | Deupree et al. |
| 5,785,216 | A | 7/1998 | Gouldson et al. |
| 5,794,363 | A | 8/1998 | Marshall et al. |
| 5,857,276 | A | 1/1999 | Marshall et al. |
| 5,884,422 | A | 3/1999 | Marshall et al. |
| D410,793 | S | 6/1999 | Gouldson |
| 5,944,237 | A | 8/1999 | Gouldson |
| D414,946 | S | 10/1999 | Gouldson |
| D418,311 | S | 1/2000 | Gouldson |
| 6,041,983 | A | 3/2000 | Sullivan et al. |
| 6,209,241 | B1 | 4/2001 | Louw |
| D441,550 | S | 5/2001 | Gouldson |
| 6,260,745 | B1 | 7/2001 | Gouldson et al. |
| 6,264,075 | B1 | 7/2001 | Gouldson et al. |
| 6,289,569 | B1 | 9/2001 | Marshall et al. |
| D449,744 | S | 10/2001 | Zuckerman |
| D454,006 | S | 3/2002 | Gouldson |
| 6,357,638 | B2 | 3/2002 | Gouldson |
| 6,378,744 | B2 | 4/2002 | Olk et al. |
| 6,382,478 | B2 | 5/2002 | Gouldson et al. |
| 6,422,437 | B2 | 7/2002 | Gouldson et al. |
| 2001/0015361 | A1 | 8/2001 | Gouldson |
| 2002/0113100 | A1 | 8/2002 | Goudlson |
| 2003/0015485 | A1 | 1/2003 | Gouldson |

* cited by examiner

GARMENT HANGER AND INFORMATION INDICATOR THEREFOR

CROSS-REFERENCE TO RELATED APPLICATION

This application is based on and claims priority to U.S. Provisional Application No. 60/363,890, filed Mar. 13, 2002, and entitled Garment Hanger And Information Indicator Therefor, the entire disclosure of which is incorporated by reference herein.

BACKGROUND OF THE INVENTION

The present invention relates to hangers for articles, such as articles in combination with a separately formed indicator secured to the hanger for indicating information associated with the articles.

When articles are displayed in retail stores on hangers, it is essential that the customer be able to determine with ease information associated with the articles, such as the size, manufacturer and price.

It is known to provide hangers with indicators which attach to a web that extends from the hook of the hanger. There are basically three types of indicators which attach to the web of the hanger, one having an open top, a second having a closed top and a third which is side mounted.

An open top indicator is described, for example, in U.S. Pat. No. 5,503,310. The indicator is a hollow four-sided body defining an open top, an open bottom, a generally parallel pair of opposed sides, and a pair of opposed ends connecting the sides. The sides of the indicator include inwardly extending abutments which engage outwardly extending flanges on the web of the hook. The abutment and corresponding flanges are located in the lower one-third of the indicator proximal to the open bottom through which the web of the hook is inserted. With this open top and open bottom design and the placement of the abutments in the lower one-third of the indicator, the indicator is relatively easily removed from the web by deforming the sides of the indicator such that the abutments and flanges no longer engage each other. The deformation of the indicator sides is possible because the indicators are generally formed from plastic materials which are readily deformable. When the abutment and the flange are no longer engaged, the indicator may then be slid upwardly off the web of the hook. Thus, non-destructive removal of the open top indicator from the hanger is not only possible, but also intended.

A closed top indicator is described, for example, in U.S. Pat. Nos. 5,388,354, 5,775,553 and 5,794,363. These indicators generally have a hollow four-sided body defining a closed top, an open bottom, a generally parallel pair of opposed sides, and a generally parallel pair of opposed ends connecting the sides. The sides of the indicator include apertures which engage with outwardly extending abutments on the web of the hook. The apertures which engage the corresponding abutments are located in the lower one-third of the indicator proximal to the open bottom through which the web of the hook is inserted. With this closed top design and placement of the apertures in the lower one-third of the indicator, the indicator is relatively easily removed from the web by deforming the sides of the indicator with a finger, for example, such that the apertures and abutments no longer engage each other. The deformation of the indicator sides is possible because the indicators are generally formed from plastic materials which are readily deformable. When the apertures and abutments are no longer engaged, the indicator may then be slid upwardly off the web of the hook. Thus, non-destructive removal of the closed top indicator from the hanger is possible.

Side mounted indicators are indicators which are mounted between the hook of the hanger and the hanger body, such as those disclosed in U.S. Pat. Nos. 5,096,101, 5,305,933, and 5,687,887. Although certain of these side size indicators, such as those disclosed in U.S. Pat. No. 5,096,101 and U.S. Pat. No. 5,687,887 are intended to prevent removal of the indicator after the indicator is secured to the hanger, this requires that the indicator be accurately attached to the hanger. However, this may not happen as a result of a number of different malfunctions during the process of attachment. For example, the dispensing machine used in the attachment process may go out of adjustment or, it may malfunction in another way, such as by jamming or, if instead of using a machine, the sizer is put on manually, it is not pushed on with sufficient force.

It is desired, however, to have the indicator be essentially non-removable from the web of the hanger even if there is a malfunction in the attachment. This is because the relatively small size of the indicator may, for example, present a choking hazard for children.

SUMMARY OF THE INVENTION

The present invention provides an indicator which is essentially non-removable from the web of a hanger even if there is a malfunction in the attachment without destruction of the indicator itself.

In an exemplary embodiment, the present invention includes a garment hanger an and associated indicator therefor. The garment hanger has an outwardly projecting web which includes at least one recess on one side thereof. The indicator comprises a body having a pair of side walls, a pair of end walls connecting the side walls, a top wall and an open end arranged so as to define a cavity which is dimensioned to receive the outwardly projecting web of the hanger. The indicator further includes an abutment positioned on one side wall of the pair of side walls. The abutment is dimensioned so as to engage the at least one recess of the outwardly projecting web of the hanger and is located proximal to the top wall relative to a midpoint of the cavity between the open end and the top wall.

Advantageously, there are two recesses located one above the other in the sidewall of the web. This provides additional assurance of engagement of the abutment in the event the indicator is not fully pushed down on the web by providing engagement with at least one of the recesses.

Preferably, there are a pair of opposing abutments structured and arranged to engage recesses on each sidewall of the web.

Among the advantages to this design is that the location of abutments of the indicator side walls insures that the indicator is not easily removable from the web of the hanger. This is because the location of the abutments enables the abutments to remain in engagement with the recesses of the web even when the side walls of the indicator are deflected.

BRIEF DESCRIPTION OF THE DRAWINGS

Other features and advantages of the present invention will become apparent from the following description of the invention which refers to the accompanying drawings, wherein.

DETAILED DESCRIPTION OF EMBODIMENTS OF THE INVENTION

Figure 1:
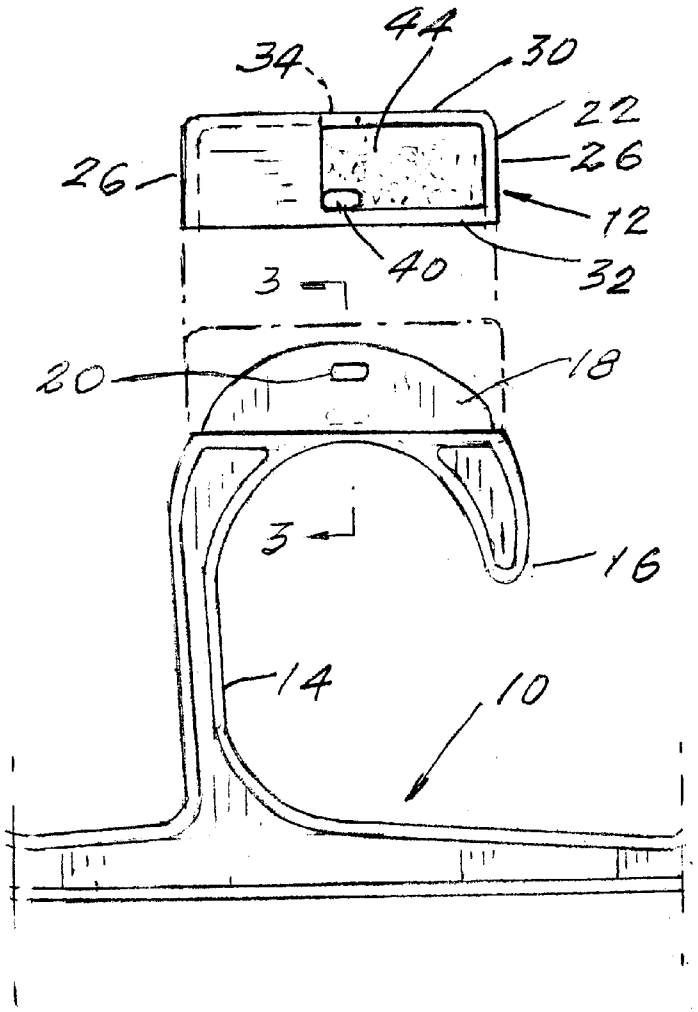
FIG. 1 is an exploded, elevational view of a hanger and an indicator with portions removed illustrating certain principles of the invention.
Figure 2:
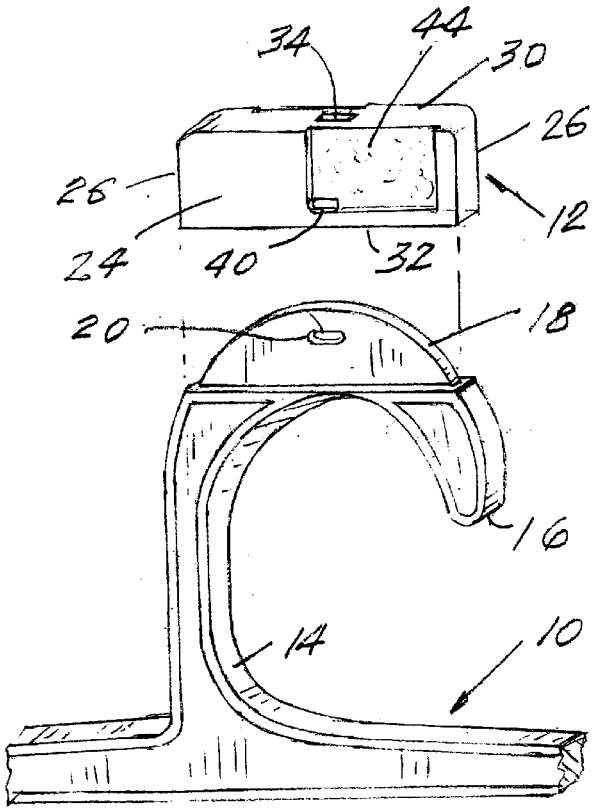
FIG. 2 is an exploded, perspective view of the hanger and indicator of FIG. 1.
Figure 3:
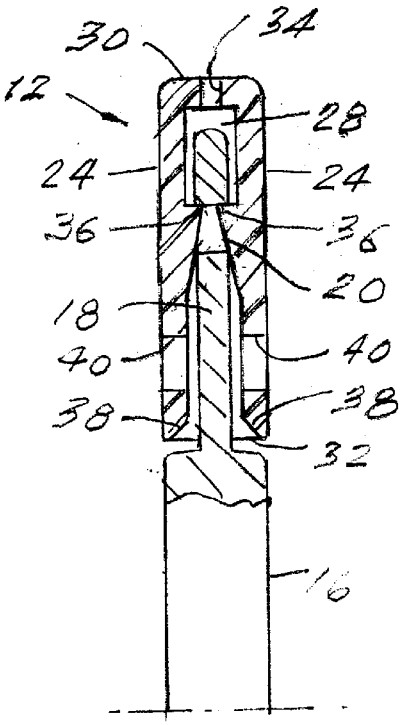
FIG. 3 is a cross-sectional view taken along the lines 3—3 in FIG. 1 of a first embodiment of a hanger and indicator in accordance with the present invention.

Referring now to the drawings, FIGS. 1–3 show a hanger 10 and indicator 12 in accordance with a first embodiment of the present invention. The hanger 10 includes a body 14, a hook portion 16 and an upwardly projecting web 18. The upwardly projecting web 18 includes at least one recess 20 on one side thereof. Alternatively, the recess 20 may be formed as an aperture which extends through the web 18.

The indicator 12 is dimensioned so as to fit over and engage the web 18 of the hanger. The indicator 12 includes a body having two generally planar opposed side walls 24, 24, and two generally planar opposed end walls 26, 26 which connect the side walls 24, 24 to form a cavity 28 which accepts the web 18 of the hanger 10. The indicator 12 also includes a substantially closed top wall 30 and an open bottom end 32. The top wall 30 may include an aperture 34 to assist in the proper injection molding of the indicator 12.

The indicator 12 is designed to be substantially permanently attached to the web 18 of the hook 16. To accomplish this, the indicator 12, as best seen in FIG. 3, is provided with at least one abutment 36, that is positioned on the inner side of one side wall 24 of the pair of side walls 24 and dimensioned so as to engage the at least one recess 20 of the web 18 of the hanger 10. Preferably, an abutment 36 is provided on the inside of each side wall 24. In order to insure that the indicator 12 is not easily removable from the web 18 of the hanger 10, the abutments 36, 36 are located proximal to the top wall 30 of the indicator 12 relative to a midpoint of the cavity 28 between the open bottom end 32 and the top wall 30. Preferably, the abutments 36, 36 are positioned on the side wall, 24, 24 within an upper one-third area of the cavity 18 proximal to the top wall 30. This location of the abutments 36, 36 enable the abutments 36, 36 to remain in engagement with the recesses 20 of the web even when the side walls 24, 24 of the indicator 12 are deflected.

Further, a lower edge 38 of at least one side wall 24 of the indicator 12 is angled inwardly to facilitate entry of the web 18 into cavity 28 of the indicator 12. Preferably, the lower edges 38, 38 of each side wall 24, 24 are angled inwardly, as shown in FIG. 3.

Also, the pair of side walls 24, 24 may each be provided with a respective aperture 40,40 located below the abutments 36, 36. The respective apertures 40, 40 are dimensioned so as to enable sorting of the indicator 12 into a proper orientation before automated or manual placement onto the web 18 of the hanger 10.

At least one of the side walls 24, 24 has a portion 44 which is slightly recessed to receive size or other information associated with an article.

Figure 4:
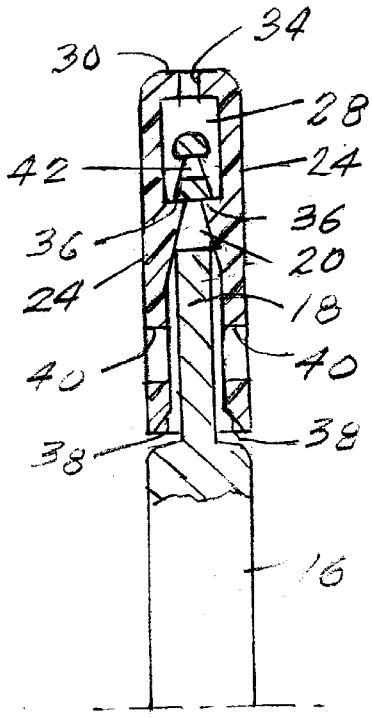
FIG. 4 is a cross-sectional view similar to FIG. 3 of a second embodiment of a hanger and indicator in accordance with the present invention.

A second embodiment of the present invention is shown in FIG. 4. The second embodiment is similar to that of the first embodiment described above. Accordingly, like reference numerals represent like elements. The second embodiment differs from the first embodiment in that the web 18 includes at least an additional recess 42 on one side of the web 18. Alternatively, the additional recess 42 may be formed as an aperture which extends through the web 18. As shown in FIG. 4, the web 18 preferably includes at least recesses 20 and 42 on each side of the web 18.

The two sets of recesses 20 and 42 sequentially engage their corresponding abutment 36 as the web 18 enters the cavity 28 of the indicator 12. This enables the indicator 12 to be attached to the web 18 even if an automatic assembly machine, for example, does not seat the indicator 12 completely on the web 18 of the hanger 10. Accordingly, a misalignment in the assembly of the indicator 12 onto the web 18 may not adversely effect the retention of the indicator 12 on the web 18, since it is likely that the indicator 12 will engage at least the top most set of recesses, i.e., the recesses 42. If this occurs, at a later point in time, the indicator 12 can be manually further pressed into engagement with the lower set of recesses, 20, 20, such that the indicator 12 can be seated in the proper location on the web 18.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An indicator for attachment to a projecting web of a hanger, the indicator comprising:

a body having a pair of side walls, a pair of end walls connecting the side walls, a top wall and an open end arranged so as to define a cavity, the cavity being dimensioned to receive the projecting web of the hanger and the projecting web of the hanger having at least one recess therein; and an abutment positioned on at least one side wall of the pair of side walls, the abutment positioned on the side wall within an upper one-third area of the cavity between the open end and the top wall and being structured and arranged to engage the recess in the web to secure the body to the web.

2. The indicator according to claim 1, wherein a lower edge of at least one side wall of the pair of side walls is angled inwardly to facilitate entry of the web into the cavity.

3. An indicator for attachment to a projecting web of a hanger, the indicator comprising:

a body having a pair of side walls, a pair of end walls connecting the side walls, a top wall and an open end arranged so as to define a cavity, the cavity being dimensioned to receive the projecting web of the hanger and the projecting web of the hanger having at least one recess therein; and an abutment positioned on at least one side wall of the pair of side walls, the abutment being located above a midpoint of the cavity between the open end and the top wall and being structured and arranged to engage the recess in the web to secure the body to the web;

wherein the pair of side walls each include a respective aperture, the respective apertures being located below the abutment and dimensioned so as to enable sorting of the indicator.

4. An indicator for attachment to a projecting web of a hanger, the indicator comprising:

a body having a pair of side walls, a pair of end walls connecting the side walls, a top wall and an open end arranged so as to define a cavity, the cavity being dimensioned to receive the outwardly projecting web of the hanger and the projecting web of the hanger having at least one recess on opposite sides of the web; and first and second abutments positioned on respective ones of the pair of side walls, each abutment being located above a midpoint of the cavity between the open end and the top wall and each being structured and arranged to engage a respective one of the recesses in the web to secure the body to the web.

5. The indicator according to claim 4, wherein each abutment is positioned on the side wall within an upper one-third area of the cavity proximal to the top wall.

6. The indicator according to claim 4, wherein a lower edge of each one side wall of the pair of side walls is angled inwardly to facilitate entry of the web into the cavity.

7. The indicator according to claim 4, wherein the pair of side walls each include a respective aperture, the respective apertures being located below the abutment and dimensioned so as to enable sorting of the indicator.

8. In combination;

a garment hanger having a projecting web, the projecting web including at least one recess on one side thereof; and an indicator, the indicator comprising:

a body having a pair of side walls, a pair of end walls connecting the side walls, a top wall and an open end arranged so as to define a cavity, the cavity being dimensioned to receive the projecting web of the hanger and the projecting web of the hanger having at least one recess therein; and an abutment positioned on at least one side wall of the pair of side walls, the abutment being located above a midpoint of the cavity between the open end and the top wall and being structured and arranged to engage the recess in the web to secure the body to the web.

9. The combination according to claims 8, wherein the abutment is positioned on the side wall within an upper one-third area of the cavity proximal to the top wall.

10. The combination according to claim 8, wherein a lower edge of at least one side wall of the pair of side walls is angled inwardly to facilitate entry of the web into the cavity.

11. The combination according to claim 8, wherein the pair of side walls each include a respective aperture, the respective apertures being located below the abutment and dimensioned so as to enable sorting of the indicator.

12. The combination according to claim 8, wherein the outwardly projecting web includes at least two recesses, each recess sequentially engaging the abutment as the web enters the cavity.

13. The combination according to claim 8, wherein the abutment is a first abutment located on one side of the indicator, the indicator includes a second abutment on the other side wall of the indicator and the web includes at least one recess on each side of the web, each of the first and second abutments being dimensioned so as to respectively engage the at least one recess on each side of the web.

14. The combination according to claim 8, wherein the abutment is a first abutment located on one side of the indicator, the indicator includes a second abutment on the other side wall of the indicator and the web includes at least two recesses on each side of the web, each of the first and second abutments being dimensioned so as to sequentially engage the at least two recesses on each side of the web as the web enters the cavity.

15. An indicator for attachment to a projecting web of a hanger, the indicator comprising:

a body having a pair of side walls, a pair of end walls connecting the side walls, a top wall and an open end arranged so as to define a cavity, the cavity being dimensioned to receive the projecting web of the hanger; and a securing element for engagement with the web, the securing element being positioned on a at least one side wall of the pair of side walls at a location above a midpoint of the cavity between the open end and the top wall, the securing element and the web being respectively structured and arranged such that engagement of the securing element with the web secures the body to the web.

* * * * *